United States Patent [19]

Kawamata

[11] 4,416,576

[45] Nov. 22, 1983

[54] METHOD OF FORMING SCORE IN CAN END PLATE AND METHOD OF ATTACHING TAB TO THE SAME FOR FACILITATING THE OPENING OF CAN

[76] Inventor: Kiyoshi Kawamata, 2-337 Takahana Cho, Ohmiya City, Saitama Prefecture, Japan

[21] Appl. No.: 319,878

[22] Filed: Nov. 9, 1981

[30] Foreign Application Priority Data

Mar. 30, 1981 [JP] Japan ..... 56-46847

[51] Int. Cl.[3] ..... B21D 51/38

[52] U.S. Cl. ..... 413/12; 413/17; 413/19; 413/59; 413/67

[58] Field of Search ..... 413/12, 14, 16, 17, 413/19, 59, 66, 67

[56] References Cited

U.S. PATENT DOCUMENTS

| | | | |
|---|---|---|---|
| 3,273,234 | 9/1966 | Henchert | 413/14 |
| 3,463,107 | 8/1969 | Lipske | 413/14 |
| 3,832,963 | 9/1974 | Gayner | 413/12 |
| 3,884,382 | 5/1975 | Ball | 413/14 |
| 4,004,530 | 1/1977 | Walter | 413/14 |
| 4,208,976 | 6/1980 | Stelter | 413/14 |
| 4,309,952 | 1/1982 | Tabahashi | 413/12 |

*Primary Examiner*—Leon Gilden

*Attorney, Agent, or Firm*—Wenderoth, Lind & Ponack

[57] ABSTRACT

A method of providing a can end plate with a score and a tab for facilitating the opening of the can. The method comprises the steps of lining the can end plate with a layer of a thermoplastic resin at at least one side thereof, forming a score in the can end plate through the layer of thermoplastic resin and attaching a tab member to the can end plate, and heating and pressing the thermoplastic resin to melt, press and charge the thermoplastic resin into the score while sealing the juncture between the tab member and the can end plate by means of the thermoplastic resin, thereby to completely eliminate any leak or exudation of the content through the score and the juncture between the tab member and the can end plate.

3 Claims, 17 Drawing Figures

METHOD OF FORMING SCORE IN CAN END PLATE AND METHOD OF ATTACHING TAB TO THE SAME FOR FACILITATING THE OPENING OF CAN

BACKGROUND OF THE INVENTION

1. Field of the Invention

The present invention relates to a method of providing the end plate of a can with a score and a tab for opening the can. More particularly, the invention is concerned with a method of providing the end plate of a can with a score and a tab, wherein the score is charged with a molten thermoplastic resin and the fixed portion of the tab is applied also with a thermoplastic resin.

2. Description of the Prior Art

It is well known to form a score in the end plate of a can in order to facilitate the opening of the can. The score, however, often permits an exudation or leak of the can therethrough undesirably. To avoid this problem, it has been proposed to attach a foil to the portion of the end plate where the score is formed or to press the portion of the end plate where the score is to be formed thereby to reduce the thickness at that portion to facilitate the opening.

The first method, i.e. the attaching of the foil requires a complicated apparatus for supplying and attaching the foil to the scored portion. The second method, i.e. the thinning by pressing makes the portion where the score is to be formed excessively hard, resulting in a reduced toughness.

SUMMARY OF THE INVENTION

Accordingly, an object of the invention is to provide a method of providing the end plate of a can with a score and a tab for facilitate the opening of the can, capable of ensuring an easy opening of the can and preventing the leak or exudation of the content completely, while preventing the tab from tearing off during the opening of the can.

To this end, according to the invention, there is provided a method of providing the end plate of a can with a score and a tab, characterized by comprising the steps of: forming a score in the reverse side, obverse side or each side of a can end plate coated with a thermoplastic resin layer; pressing and heating the thermoplastic resin layer by means of a heating device to melt, press and charge the thermoplastic resin into the score; fitting a tab blank into a tab attaching hole in the scored region of the can end plate; heating and pressing the tab blank to form an anchoring portion; and applying the molten thermoplastic resin also to the fixing portion of projection of the tab. In the case where the scored plate is made of a material different from the material of the end plate of the can, the thermoplastic resin is applied also to the juncture between the scored plate and the end plate.

BRIEF DESCRIPTION OF THE DRAWINGS

FIGS. 2 to 4 are enlarged sectional views of the can end plate showing the step of charging the score with the molten thermoplastic resin, in which:

FIG. 2 shows the operation by a heating device having a concaved pressing surface;

FIG. 3 shows the operation by a heating device having a convexed pressing surface; and FIG. 4 shows the operation by a heating device having a flat pressing surface;

Description of the Preferred Embodiments

Figure 1:
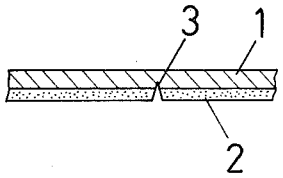
FIG. 1 is an enlarged sectional view of a portion of an end plate of a can coated with a layer of a thermoplastic resin and then scored, in the state before the charging of the plastic into the score.

Referring first to FIG. 1, and end plate 1 of a can is beforehand coated at its reverse side with a layer 2 of a thermoplastic resin such as polyethylene. Then, a score 3 is formed in the end plate 1 from the same side as the resin layer 2 to a depth of $\frac{1}{3}$ (one third) to $\frac{1}{2}$ (half) of the thickness of the end plate 1. Then, as will be seen from FIG. 2, a heating device 4 is pressed against the resin layer 2 around the score 3 to heat the resin layer to a temperature about 20° to 30° C. higher than the melting point of the resin to melt and charge the molten resin into the score 3 by the pressure exerted by the heating device 4. The temperature to which the resin layer is heated is about 100° to 120° C. when the resin is polyethylene.

In some cases, the end plate of the can is provided at its reverse side with a score to the depth of $\frac{1}{3}$ to $\frac{1}{2}$ of the thickness thereof, and is then lined at its reverse side with the layer of thermoplastic resin. Then, the resin around the score is heated and pressed by the heating device so as to be molten and charged into the score.

The score may be formed not only in the reverse side of the end plate but also in the obverse side or each side of the end plate lined beforehand with the layer of the thermoplastic resin.

The time length of heating of the thermoplastic resin by the heating device is selected to be long enough to permit the resin to be molten and forcibly charged into the score. Usually, this heating time is within the order of several seconds.

Figure 2:
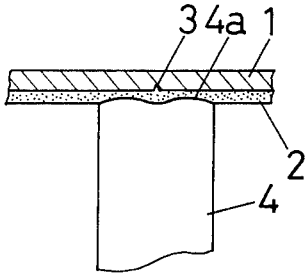
Figure 3:
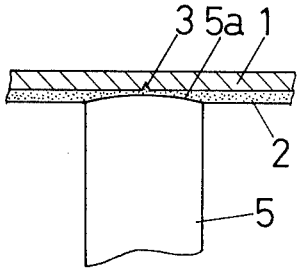
Figure 4:
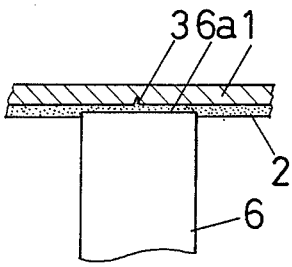

The shape of the pressing surface of the heating device 4 can be varied depending on various factors such as the material of the thermoplastic resin, thickness of the resin layer and so forth. For instance, the pressing surface of the heating device 4 can have a concaved form 4*a* as shown in FIG. 2, convexed form 5*a* as shown in FIG. 3, planar form 6*a* as shown in FIG. 4 and so forth.

Also, the end plate of the can may be formed with a sheet of metal, aluminum, synthetic resin or processed paper.

Figure 15:
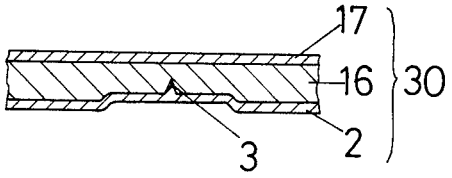
FIG. 15 is an enlarged sectional view of a can end plate made from a processed paper scored at its reverse side.
Figure 16:
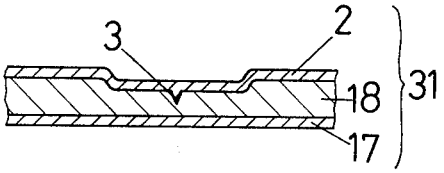
FIG. 16 is an enlarged sectional view of a can end plate made from a processed paper scored at its obverse side.

In the case where the processed paper is used as the material of the can end plate, a sheet of paper 16 is beforehand applied at its obverse side with a water-proof synthetic resin layer 17 and at its reverse side with the layer 2 of thermoplastic resin layer. Then, the score 3 is formed from the reverse side and the thermoplastic resin is molten, pressed and charged into the score 3 by means of the heating device 4 as shown in FIGS. 2 to 4 to form a processed paper 30 as shown in FIG. 15. According to another way of forming the processed paper, a sheet of paper 18 is beforehand lined at its reverse side with the water-proof synthetic resin layer 17 and at its obverse side with the layer 2 of the thermoplastic resin. Then, the score 3 is formed in the obverse side and the thermoplastic resin is molten, pressed and charged into the score 3 by means of the heating device as shown in FIGS. 2 to 4, to form the processed paper 31 as shown in FIG. 16.

Figure 17:
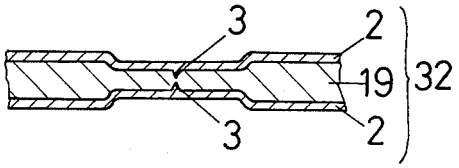
FIG. 17 is an enlarged sectional view of a can end plate made from a processed paper scored at its both sides.

According to still another way of forming the processed paper, a sheet of paper 19 lined beforehand with layers 2,2 of thermoplastic resin at its both sides are scored in both surfaces thereof as at 3,3 and the thermoplastic resin are molten, pressed and charged into the scores 3,3 to form the processed paper 32 as shown in FIG. 17.

In the final state of the can end plate, the thermoplastic resin around the score is somewhat recessed from the surface of other portion of the resin, due to the heating and pressing by the heating device.

Figure 5:
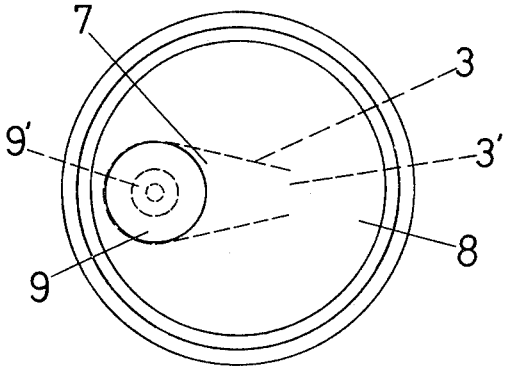
FIG. 5 is a plan view of a can end plate having a scored region provided at its one end with a non-scored portion and a tab at its other end.
Figure 6:
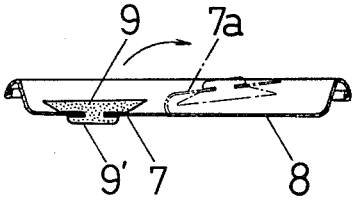
FIG. 6 is a schematic side elevational sectional view of the can plate as shown in FIG. 5.

The score 3 can be formed in any desired shape. In some cases, the scored region 7 can have a discontinuity 3′ of the score at its one end as shown in FIGS. 5 and 6. In such cases, the scored plate 7*a* remains connected to the can end plate 8 through the discontinuity 3′ of the score, even after the end plate 8 is opened along the score 3.

Figure 7:
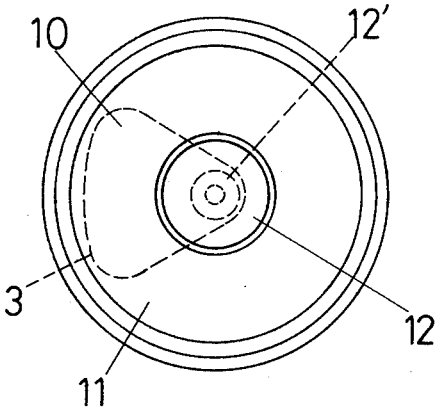
FIG. 7 is a plan view of a can end plate having a triangular scored region provided at its one end with a knob.
Figure 11:
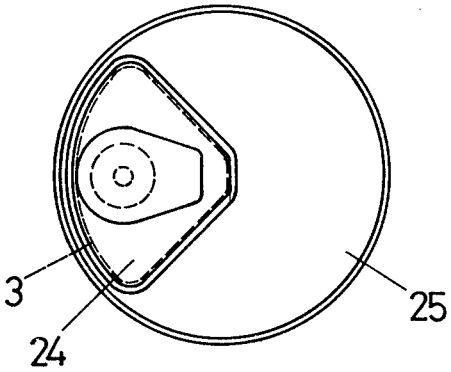
FIG. 11 is a plan view of an end panel of a can having a sector-shaped scored region made of a material different from that of the can end plate.
Figure 12:
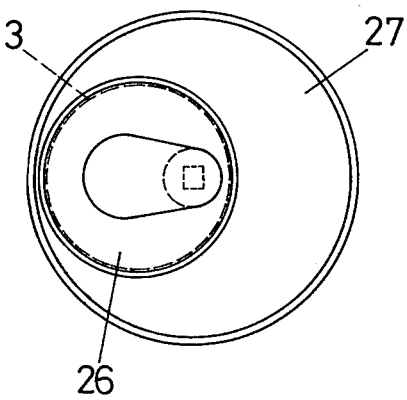
FIG. 12 is a plan view of an end panel of a can having a circular scored region made of a material different from that of the can end plate.

Thus, the scored region 7 can have a suitable configuration selected in accordance with the shape of the content of the can to facilitate the taking out of the content from the can. For instance, the score can be formed to provide a triangular scored region 10 (See FIG. 7), oval scored region 13 (see FIG. 8), sector-shaped scored region 24 (See FIG. 11), circular scored region 26 (See FIG. 12), semi-circular scored region 28 (See FIG. 13) and other shapes of scored region.

Figure 8:
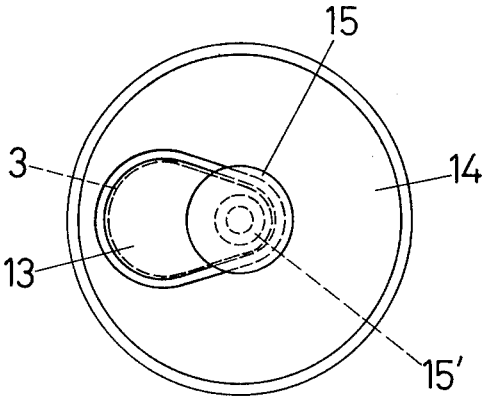
FIG. 8 is a plan view of an end panel of a can having an oval scored region made of a material different from that of the can end plate.
Figure 9:
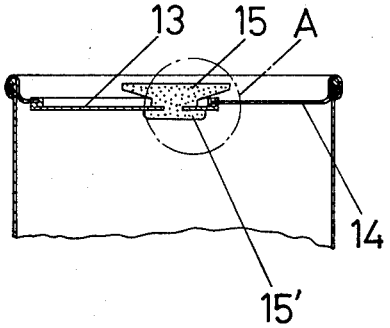
FIG. 9 is a side elevational sectional view of the end panel as shown in FIG. 8.
Figure 10:
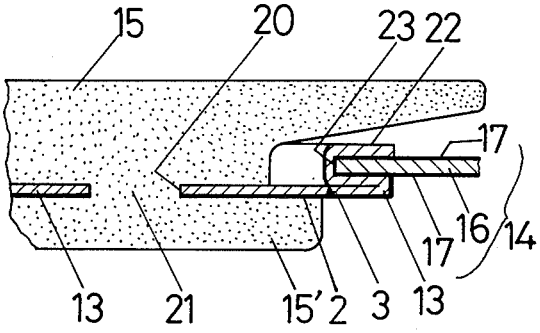
FIG. 10 is a partial enlarged sectional view of the dotted circle section of FIG. 9.

FIGS. 8,9 and 10 show another embodiment in which the can end plate 14 and the scored region 13 are made from different materials. For instance, the can end plate 14 is made from a processed paper 16 which is lined at its both sides with water-proof synthetic resin layers 17,17, while the scored region 13 is formed from an aluminum sheet or a synthetic resin sheet lined beforehand with a thermoplastic synthetic resin layer 2 at its reverse side and then is scored through the resin layer 2, the score 3 being then filled with the thermoplastic resin which is molten and pressed by the heating device 4 as shown in FIGS. 2 to 4. In this case, the scored region 13 is made to fit in an attaching opening formed in the can end plate 14 and the opening brim 23 of the can end plate 14 is clamped tightly by the peripheral bend 22 of the scored region 13 as shown best in FIG. 10 in an airtight manner, so that the leak or exudation of the content through the juncture between the can end plate 14 and the scored region 13 is completely avoided.

Figure 13:
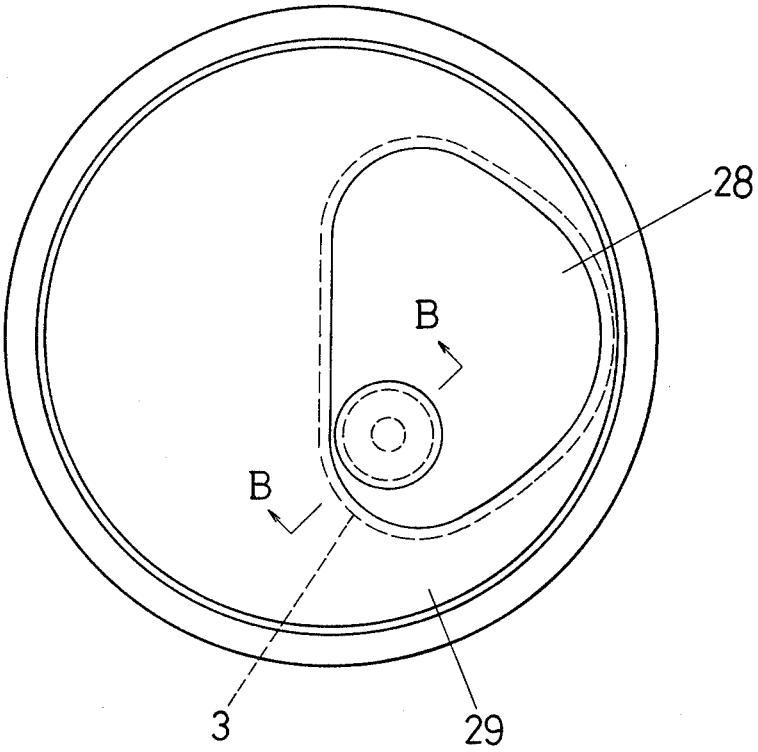
FIG. 13 is a plan view of an end panel of a can having a semi-circular scored region made of a material different from that of the can end plate.
Figure 14:
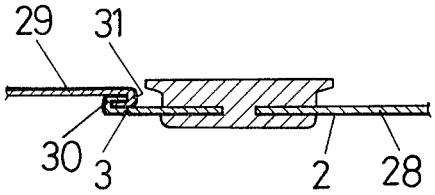
FIG. 14 is an enlarged side elevational sectional view taken along the line B—B of FIG. 13.

FIGS. 13 and 14 show still another embodiment in which a semi-circular scored region 28 is attached to a can end plate 29. More specifically, a downward bent 31 is formed along the inner periphery of a semi-circular attaching opening in the can end plate 29, so as to fit and engage an outer peripheral bend 30 of the scored region 28 in an airtight manner, as will be clearly seen from FIG. 14. The leak or exudation of the content is prevented also in this case. It is to be noted that, since the score 3 in this case is formed to underlie the bend 31, the keen edge formed after the opening of the can end plate does never appear to the outside of the peripheral bend 30 of the scored region 28.

According to the invention, it is also possible to provide the can end plate with a tab for facilitating the the opening. To his end, as will be seen from FIGS. 8, 9 and 10, a tab member 15 having an attaching projection 21 is fitted in an attaching opening 20 formed in the scored region 13. Then, the attaching projection 21 is heated and pressed by a heating device to form an anchoring portion 15. Simultaneously with the heating and pressing of the tab member 15, the layer 2 of the thermoplastic resin around the score 3 is molten to integrally connect the mounting projection 21, anchoring portion 15′ and the scored region 13. The undesirable leak or exudation of content, as well as tearing off of the tab member 15, therefore, is completely eliminated.

Usually, a synthetic resin such as polypropylene is used preferably but not exclusively as the material of the tab member.

As will be seen from the foregoing description, according to the method of the invention for providing a can end plate with a score and a tab for facilitating the opening, a thermoplastic resin is molten, pressed and charged into the score to improve the tightness of the seal along the score. In addition, the thermoplastic resin is applied also to the juncture between the tab and the scored region thereby to prevent tearing off of the tab when the latter is pulled and to eliminate the leak or exudation of the content through the juncture between the tab and the scored region.

Although the invention has been described through specific terms, it is to be noted here that the described embodiment are illustrative purpose only, and various changes and modifications may be imparted thereto without departing from the scope of the invention which is limited solely by the appended claims.

What is claimed is:

1. A method of providing a can end plate with a score and a tab for facilitating the opening, comprising the steps of: coating said can end plate with a layer of a thermoplastic resin at at least one side of said can end plate; forming a score in said can end plate through said layer of thermoplastic resin such that a tab attaching opening formed in said can end plate is surrounded by said score; fitting an attaching projection of a tab member formed of a synthetic resin in said tab attaching opening; and heating and pressing said attaching projection by a heating device to form an anchoring portion while melting, pressing and charging said thermoplastic resin into said score and also sealing the juncture between said tab and said can end plate with said thermoplastic resin.

2. A method of providing a can end plate with a score and a tab as claimed in claim 1, wherein said can end plate is beforehand provided with a score and a tab, and said thermoplastic resin is molten, pressed and charged into said score and said tab is applied with said thermoplastic resin as the latter is pressed by said heating device.

3. A method of providing a can end plate with a score and a tab as claimed in either one of claims 1 and 2, wherein the scored region is formed of a material different from that of said can end plate.

* * * * *